US007127200B2

(12) United States Patent
Nakamura et al.

(10) Patent No.: US 7,127,200 B2
(45) Date of Patent: Oct. 24, 2006

(54) DEVELOPING ROLLER, ELECTROPHOTOGRAPHIC PROCESS CARTRIDGE, AND ELECTROPHOTOGRAPHIC IMAGE FORMING APPARATUS

(75) Inventors: Minoru Nakamura, Shizuoka (JP); Arihiro Yamamoto, Shizuoka (JP); Kazutoshi Ishida, Shizuoka (JP); Takeshi Suzuki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/952,741

(22) Filed: Sep. 30, 2004

(65) Prior Publication Data

US 2005/0078986 A1 Apr. 14, 2005

(30) Foreign Application Priority Data

Oct. 10, 2003 (JP) ..... 2003-352494

(51) Int. Cl.
*G03G 15/08* (2006.01)

(52) U.S. Cl. ..... 399/286; 399/276; 399/265; 492/18; 492/49; 492/53; 492/56; 430/120

(58) Field of Classification Search ..... 399/286
See application file for complete search history.

(56) References Cited

U.S. PATENT DOCUMENTS 5,477,006 A * 12/1995 Imamiya et al. ..... 399/285
5,875,379 A * 2/1999 Machida et al. ..... 399/284
5,893,014 A * 4/1999 Goto et al. ..... 399/286
6,393,243 B1 5/2002 Satoh et al. ..... 399/286
6,512,911 B1 * 1/2003 Arai et al. ..... 399/286

FOREIGN PATENT DOCUMENTS

EP 1286225 A2 * 2/2003
JP 2001-42631 2/2001

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

A developing roller is provided having an elastic layer and a surface layer superposed thereon. The surface layer is formed of a resin material containing nitrogen atoms, and contains at least two types of particles, organic-compound particles (M) and organic-compound particles (N). The particles (N) are composed of nitrogen-containing heterocyclic-compound particles. The number-average particle diameter of the particles (N) in the surface layer is smaller than the number-average particle diameter of the particles (M) in the surface layer. Where the universal hardness of the elastic layer is represented by A and the universal hardness of the developing roller is represented by B, they satisfies $0.9 \leqq B/A \leqq 1.8$.

13 Claims, 1 Drawing Sheet

DEVELOPING ROLLER, ELECTROPHOTOGRAPHIC PROCESS CARTRIDGE, AND ELECTROPHOTOGRAPHIC IMAGE FORMING APPARATUS

BACKGROUND OF THE INVENTION

1. Field of the Invention

This invention relates to a developing roller and a developing assembly which are used in, e.g., electrophotographic apparatus such as copying machines and laser beam printers.

2. Related Background Art

Conventionally, in electrophotographic apparatus or electrostatic recording apparatus, such as copying machines and laser beam printers, a pressure developing method is known as a developing method, in which a non-magnetic one-component developer is fed to, e.g., a photosensitive drum which is holding a latent image thereon and the developer is made to adhere to the latent image (electrostatically charged image) to render the latent image visible. According to this method, any magnetic material is not required, and hence the image forming apparatus can be easily simplified and miniaturized or toners can be easily made into color toners.

In this developing method, a developing roller holding a toner (non-magnetic one-component developer) thereon is brought into contact with a latent image bearing member holding an electrostatic latent image thereon, such as a photosensitive drum, to attach the toner to the latent image to perform development. Hence, the developing roller must be formed of a conductive elastic member.

This method in which the developing roller is brought into contact with the photosensitive drum to develop the latent image with the toner is necessarily required to ensure the uniformity of a toner layer on the developing roller and the charging uniformity of the toner. However, in recent years, with the increase of printing speed and the improvement of image quality, the precision required of the developing roller has become increasingly severer. As one thing therefor, depending on the precision of engagement of gears which drive the developing roller, the toner coat layer may be disordered with gear pitches, and the charging uniformity of the toner also is disordered in a short period, so that horizontal lines due to such gear pitches (hereinafter "gear pitch horizontal lines") appear on images, which has come into question. As related background art, Japanese Patent Application Laid-Open No. 2001-042631 discloses a developing roller having an elastic layer. However, in rollers constituted commonly, if an elastic layer is merely covered thereon with a surface layer formed of a resin, the developing roller may have a much higher hardness than the hardness of the elastic layer itself, so that it may be difficult to solve the problem of the gear pitch horizontal lines.

SUMMARY OF THE INVENTION

An object of the present invention is to provide a developing roller that is effective in preventing the gear pitch horizontal lines from occurring.

Another object of the present invention is to provide an electrophotographic process cartridge and an electrophotographic image forming apparatus that are effective in preventing the gear pitch horizontal lines from occurring.

The present invention is a developing roller having an elastic layer and a surface layer, wherein the surface layer has at least a nitrogen-atom-containing resin, organic-compound particles (M) and organic-compound particles (N); the organic-compound particles (N) are nitrogen-containing heterocyclic-compound particles; a number-average particle diameter of the organic-compound particles (N) in the surface layer is smaller than a number-average particle diameter of the organic-compound particles (M) in the surface layer; and universal hardness A ($N/mm^2$) of the surface of the elastic layer and universal hardness B ($N/mm^2$) of the surface of the developing roller satisfy the relationship of the following expression (1):

$$0.9 \leqq B/A \leqq 1.8 \quad (1).$$

Such a developing roller has satisfactorily solved the problem the related background art has insufficiently solved. That is, the developing roller is very desirably responsive to any deformation of its elastic layer and surface layer, so that the toner layer can hardly be disordered in a short period and can be prevented from being non-uniformly charged because of any minute rotational non-uniformity, thus the gear pitch horizontal lines can perfectly be prevented from occurring.

DESCRIPTION OF THE PREFERRED EMBODIMENTS

The developing roller according to the present invention is one in which:

(1) a resin material forming the surface layer contains nitrogen atoms; at least two types of particles, organic-compound particles (M) and organic-compound particles (N), are added to the surface layer; the particles (N) are nitrogen-containing heterocyclic-compound particles; and the number-average particle diameter of the particles (N) in the surface layer is smaller than the number-average particle diameter of the particles (M) in the surface layer, whereby the toner can appropriately be triboelectrically charged; and (2) the relationship between universal hardness B ($N/mm^2$) of the developing roller and universal hardness A ($N/mm^2$) of the elastic layer of the developing roller is set in the range of $0.9 \leqq B/A \leqq 1.8$, whereby the developing roller is very desirably responsive to any deformation of its elastic layer and surface layer, so that the toner layer can not easily be disordered in a short period and can be prevented from being non-uniformly triboelectrically charged due to any minute rotational non-uniformity;

thus, as the whole effect of the features (1) and (2), the gear pitch horizontal lines can be prevented from occurring.

In regard to the components used to form the developing roller according to the present invention, preferable conditions are as follows:

The number-average particle diameter of the organic-compound particles (N) contained in the surface layer of the developing roller may preferably be 1.0 μm or more and 10 μm or less.

The nitrogen-containing heterocyclic-compound of the organic-compound particles (N) contained in the surface layer of the developing roller may preferably be an imidazole compound.

The imidazole compound may preferably be a compound represented by the following formula (a) or (b):

(a)

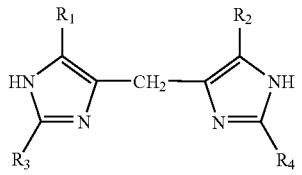

wherein $R_1$ and $R_2$ are each independently a hydrogen atom, an alkyl group, an aralkyl group or an aryl group; and $R_3$ and $R_4$ are each independently a straight-chain alkyl group having 3 to 30 carbon atoms; or (b)

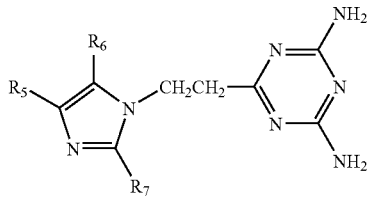

wherein $R_5$ and $R_6$ are each independently a hydrogen atom, an alkyl group, an aralkyl group or an aryl group; and $R_7$ represents a straight-chain alkyl group having 3 to 30 carbon atoms.

The electrophotographic process cartridge according to the present invention is one having the developing roller of the present invention.

The electrophotographic image forming apparatus according to the present invention is one having a latent image bearing member on which a latent image to be rendered visible by the use of a toner is formable, and the developing roller of the present invention which holds the toner on its surface to form a toner thin layer thereon and feeds the toner from the toner thin layer to the latent image bearing member.

Figure 1:
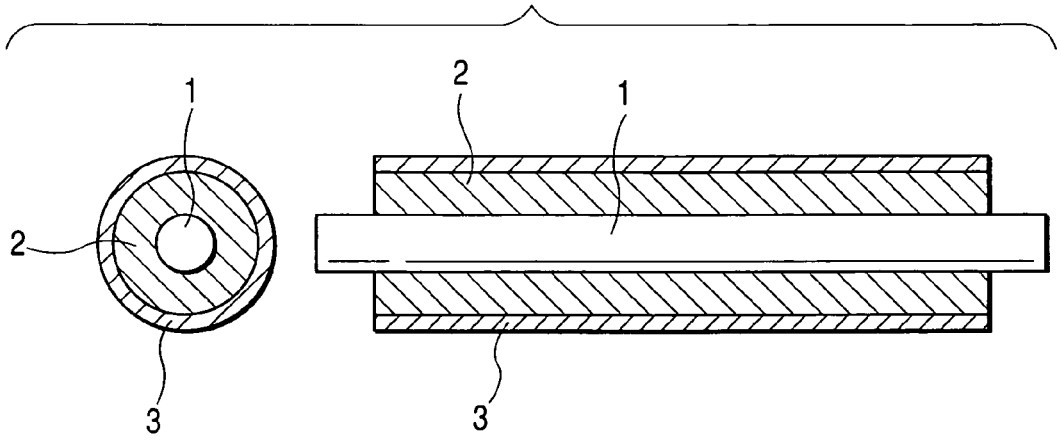
FIG. 1 is a sectional view showing the structure of the developing roller of the present invention.

The present invention is described below in greater detail. The developing roller of the present invention is, as shown in FIG. 1, formed of a shaft 1 with good conductivity provided on its periphery with a conductive elastic layer 2 covered with a surface layer 3 composed of a conductive resin. In the present invention, the developing roller has at least such an elastic layer and the surface layer superposed on the elastic layer, and is characterized in that the resin material used in the surface layer contains nitrogen atoms, and at least two types of particles, the organic-compound particles (M) and the organic-compound particles (N), are added thereto, where the particles (N) are the nitrogen-containing heterocyclic-compound particles and the particles (N) in the surface layer have a number-average particle diameter smaller than the number-average particle diameter of the particles (M) in the surface layer, and the developing roller is so constituted as to be optimized to satisfy the relationship of the following expression (1):

$$0.9 \leqq B/A \leqq 1.8 \quad (1)$$

(where, in measuring the universal hardness of the elastic layer surface and that of the developing roller surface, the universal hardness of the elastic layer and the universal hardness of the developing roller at an indentation depth of 40 μm in the vertical direction from the surface under measuring conditions of a constant loading speed (50/20 $mN/mm^2$/sec.) are represented by A ($N/mm^2$) and B ($N/mm^2$), respectively).

Here, as the shaft 1 with good conductivity, any shafts may be used as long as they have a good conductivity. Usually used is a cylindrical member of 4 mm to 10 mm in external diameter, made of a metal such as aluminum, iron or stainless steel.

As the conductive elastic layer 2 formed on the periphery of this shaft 1, a layer may be used which is formed using as a base material an elastomer or a foamed material of EPDM, urethane or the like, or other resin, and, compounded therewith, an electron-conductive substance such as carbon black, a metal or a metal oxide or an ion-conductive substance such as sodium perchlorate to adjust resistance to a suitable range of from $10^3$ to $10^{10}\Omega\cdot cm$, and preferably from $10^4$ to $10^8\Omega\cdot cm$. Here, the conductive elastic layer may preferably formed in a hardness of from 35° to 70° as Asker-C hardness. The ASKER-C hardness can be measured with an ASKER-C type spring-controlled rubber hardness meter (manufactured by Kobunshi Keiki Co., Ltd.), and is given as the value measured 30 seconds after the above-described hardness meter is brought into contact with a roller on its middle at a force of 1 kg which has been left standing for 5 hours or more in an environment of normal temperature and normal humidity (23° C., 55% RH). The conductive elastic layer may preferably be in a thickness of from 1.0 mm to 8.0 mm.

As the base material, it may specifically include polyurethane, natural rubber, butyl rubber, nitrile rubber, polyisoprene rubber, polybutadiene rubber, silicone rubber, styrene-butadiene rubber, ethylene-propylene rubber, ethylene-propylene-diene rubber, chloroprene rubber, acrylic rubber, and a mixture of any of these. Silicone rubber and EPDM may preferably be used. Especially when silicone rubber is used as the rubber material, it may include methylphenyl-silicone rubber, fluorine-modified silicone rubber, polyether-modified silicone rubber and alcohol-modified silicone rubber.

As the electron-conductive material used to provide this conductive elastic layer 2 with conductivity, it may include conductive carbons such as KETJEN BLACK EC and acetylene black, rubber-purpose carbons such as SAF, ISAF, HAF, FEF, GPF, SRF, FT and MT, color(ink)-purpose carbon subjected to oxidation treatment or the like, metals such as copper, silver and germanium, and metal oxides of any of these. In particular, carbon black is preferably used because it can readily control conductivity in a small quantity. Any of these conductive powders may usually preferably be used in the range of from 0.5 to 50 parts by weight, and particularly from 1 to 30 parts by weight, based on 100 parts by weight of the base material.

The ion-conductive substance used as the conductive material may be exemplified by the following: inorganic ion-conductive substances such as sodium perchlorate, lithium perchlorate, calcium perchlorate and lithium chloride, and also organic ion-conductive substances such as modified aliphatic dimethylammonium ethosulfate and stearylammonium acetate. At least one of these substances may be used. Its content may be selected in accordance with the intended physical properties, and may be, e.g., in the range of from 0.1 to 20% by weight.

The surface layer 3 formed of a conductive resin with which the conductive elastic layer 2 is covered may preferably contain a nitrogen-containing resin as a base material, and at least two types of particles, the organic-compound particles (M) and the organic-compound particles (N), are added thereto, of which the particles (N) are the nitrogen-containing heterocyclic-compound particles and the particles (N) is controlled to have, in the surface layer, a number-average particle diameter smaller than the number-average particle diameter of the particles (M) in the surface layer. The base material may specifically include polyamide resin, urethane resin, urea resin, imide resin and melamine resin. Any of these resins may be used alone or in the form of a mixture of two or more. Where the surface layer 3 is formed of urethane resin, it is preferred because the urethane resin has the high ability to triboelectrically charge the toner and also has wear resistance. The above organic-compound particles include particles composed of various organic compounds, and resin particles. The resin particles may include rubber particles of EPDM, NBR, SBR, CR, silicone rubber or the like; elastomer particles of thermoplastic elastomers (TPE) of polystyrene, polyolefin, polyvinyl chloride, polyurethane, polyester and polyamide types; or polymethyl methacrylate (PMMA) particles, urethane resin particles, and resin particles of fluorine resin, silicone resin, phenol resin, naphthalene resin, furan resin, xylene resin, divinylbenzene polymer, styrene-divinylbenzene copolymer, polyacrylonitrile resin or the like; any of which may be used alone or in combination. Also usable are resin particles in which a plurality of components are contained in each particle. These organic-compound particles may preferably be those having insulating properties and having a volume resistivity of $1.0\times10^9$ Ω·cm or more.

The nitrogen-containing heterocyclic-compound particles to be incorporated in the surface layer may include particles composed of a compound having a nitrogen-containing heterocyclic group, as exemplified by imidazole, imidazoline, imidazolone, pyrazoline, pyrazole, pyrazolone, oxazoline, oxazole, oxazolone, thiazoline, thiazole, thiazolone, selenazoline, selenazole, selenazolone, oxadiazole, thiadiazole, tetrazole, benzimidazole, benzotriazole, benzoxazole, benzothiazole, benzoselenazole, pyrazine, pyrimidine, pyridazine, triazine, oxazine, thiazine, tetrazine, polyazine, indole, isoindole, indazole, carbazole, quinoline, pyridine, isoquinoline, cinnoline, quinazoline, quinoxaline, phthalazine, purine, pyrrole, triazole and phenazine. These nitrogen-containing heterocyclic-compound particles may be used alone or in the form of a mixture of two or more. In the present invention, an imidazole compound is particularly preferred because it promotes the effect exhibited by the developing roller of the present invention has. Also usable are particles in which a plurality of components are contained in each particle.

The surface layer 3 comprises a base material (L), at least one organic-compound particles (M) whose number-average particle diameter is maximum, and at least one organic-compound particles (N) whose number-average particle diameter is not maximum. The components M and N to be used are so selected as to satisfy the above-described relationship of number-average particle diameters, from among the resin particles and nitrogen-containing heterocyclic-compound particles listed previously. In order to control particle diameter and more readily achieve the effect of the present invention, it is preferable that the component M is selected from the resin particles and the component N is selected from the nitrogen-containing heterocyclic-compound particles. As the mixing proportion of these, it may be selected from ranges such that, e.g., the component M is from 1.0 to 40 parts by weight, and preferably from 5.0 to 30 parts by weight, and the component N is from 0.5 to 20 parts by weight, and preferably from 1.0 to 15 parts by weight, based on 100 parts by weight of the resin base material used for the surface layer. The number-average particle diameter of the particles whose number-average particle diameter is maximum may be selected from a range of, e.g., from 1.0 mm to 30 mm, and preferably from 3.0 mm to 20 mm.

As the above-mentioned nitrogen-containing heterocyclic-compound particles, those having a number-average particle diameter of preferably from 1.0 mm to 10 mm, and more preferably from 2.0 mm to 8.0 mm, may be used. Where the nitrogen-containing heterocyclic-compound particles have a number-average particle diameter within such a range, the surface roughness of the roller can precisely be achieved, and neither coarse images nor density non-uniformity occur.

In addition, the number-average particle diameter of these particles is the value measured with a laser diffraction type particle size analyzer, Coulter LS-130 particle size analyzer (manufactured by Beckman Coulter Inc.).

The number-average particle diameter of the particles in the surface layer of the developing roller is also measured with an electron microscope. A photograph is taken at 1,000 to 60,000 magnifications. If it is difficult to do so, a photograph may be taken at lower magnification and then may be enlarged by printing so a's to be 1,000 to 60,000 magnifications. Particle diameters of primary particles are measured on the photograph. In the measurement, lengths and breadths are measured and their average value is regarded as particle diameter. This measurement is made on 100 samples, and their 50% value is regarded as the number-average particle diameter.

As the electron-conductive material used to provide this surface layer 3 with conductivity, it may include conductive carbons such as KETJEN BLACK EC and acetylene black, rubber-purpose carbons such as SAF, ISAF, HAF, FEF, GPF, SRF, FT and MT, color(ink)-purpose carbon subjected to oxidation treatment or the like, metals such as copper, silver and germanium, and metal oxides of any of these. In particular, carbon black is preferably used because it can easily control conductivity in a small quantity.

The ion-conductive substance used as the conductive material may be exemplified by the following: inorganic ion-conductive substances such as sodium perchlorate, lithium perchlorate, calcium perchlorate and lithium chloride, and also organic ion-conductive substances such as modified aliphatic dimethylammonium ethosulfate and stearylammonium acetate.

The conductive material may also be compounded in a proportion of from 1 to 50 parts by weight based on total weight 100 parts by weight of the resin used in the surface layer 3. Then, the materials included in the surface layer, such as the conductive material and the organic-compound particles, are mixed and stirred, and thereafter the mixture obtained is applied onto the conductive elastic layer by dipping or the like to form the surface layer. The materials may be mixed and dispersed by any known technique. Then, a curing agent or a curing catalyst may further appropriately be added, followed by stirring to obtain a coating material, which may be applied by a method such as spraying or dipping.

Herein, the universal hardness is a physical value determined by pushing an indenter into an object to be measured under application of a load, and is found as a value of (test load)/(surface area of indenter under test load) ($N/mm^2$). This universal hardness may be measured with a hardness measuring instrument as exemplified by Ultramicrohardness Meter H-100V, manufactured by H. Fischer GmbH. In this measuring instrument, an indenter such as a quadrangular pyramid is pushed into a object to be measured under application of a stated relatively small test load, and, at the time it has reached a stated indentation depth, the surface area with which the indenter comes into contact is found from the depth of indentation, where the universal hardness is calculated from the above expression. That is, upon pushing the indenter into the object to be measured under constant-load conditions, the stress at that point in respect to the depth in which the indenter has been indented is defined as the universal hardness.

With the developing roller of the present invention, the universal hardness under the measuring conditions defined as described above (constant loading speed: 50/20 $mN/mm^2$/sec.), at the time the indentation depth in the vertical direction from the surface of each of the elastic layer and the developing roller is 40 μm, is always so controlled as to satisfy:

$$0.9 \leqq B/A \leqq 1.8 \quad (1)$$

where the universal hardness of the elastic layer is represented by A ($N/mm^2$) and the universal hardness of the developing roller is represented by B ($N/mm^2$). According to extensive research, it has been revealed that the universal hardness at the time the indentation depth is 40 μm suitably correlates with response to any deformation of the elastic layer and surface layer. Then, the research has arrived at the discovery that when the relationship of the expression (1) is satisfied, the toner layer is not easily disrupted in a short period. Also, preferred is:

$$0.95 \leqq B/A \leqq 1.5; \text{ and}$$

more preferred is:

$$1.0 \leqq B/A \leqq 1.2.$$

If the roller is so controlled as to deviate from the relationship of the expression (1), it is difficult to satisfactorily solve the problem of the gear pitch horizontal lines.

In measuring the universal hardness of the elastic layer of the developing roller, the surface layer of the roller may be scraped off by, e.g., abrasion to expose the elastic layer, and in the state that the elastic layer is, exposed, the measurement may be carried out.

The surface layer may preferably have a thickness of from 1.0 μm to 20 μm. The surface layer may also preferably have a volume resistivity of from $1.0\times10^4$ to $1.0\times10^8$ Ω·cm.

Thus, in the manner as described above, the developing roller is obtained having at least the elastic layer and the surface layer superposed on the elastic layer, and is characterized in that the resin material used in the surface layer contains nitrogen atoms, and at least two types of particles, the organic-compound particles (M) and the organic-compound particles (N), are added thereto, of which the particles (N) are the nitrogen-containing heterocyclic-compound particles and the particles (N) have, in the surface layer, a number-average particle diameter smaller than the number-average particle diameter of the particles (M) in the surface layer, and besides, the developing roller is characterized in that it is so constituted as to satisfy the relationship of the following expression (1):

$$0.9 \leqq B/A \leqq 1.8 \quad (1)$$

(where, in measuring the universal hardness of the elastic layer surface and that of the developing roller surface, the universal hardness of the elastic layer and the universal hardness of the developing roller at an indentation depth of 40 μm in the vertical direction from the surface under the measuring conditions of a constant loading speed (50/20 $mN/mm^2$/sec.) are represented by A ($N/mm^2$) and B ($N/mm^2$), respectively).

Here, the developing roller may preferably have a surface roughness of from 0.4 μm to 2.2 μm as Ra according to JIS B 0601:2001. It may more preferably have a surface roughness of from 0.9 μm to 1.6 μm in order to obtain images with a higher grade.

The electrophotographic process cartridge according to the present invention has at least a photosensitive drum and the developing roller, and is detachably mountable to the main body of the electrophotographic image forming apparatus through a guide means such as rails provided in the main body of the apparatus.

Figure 2:
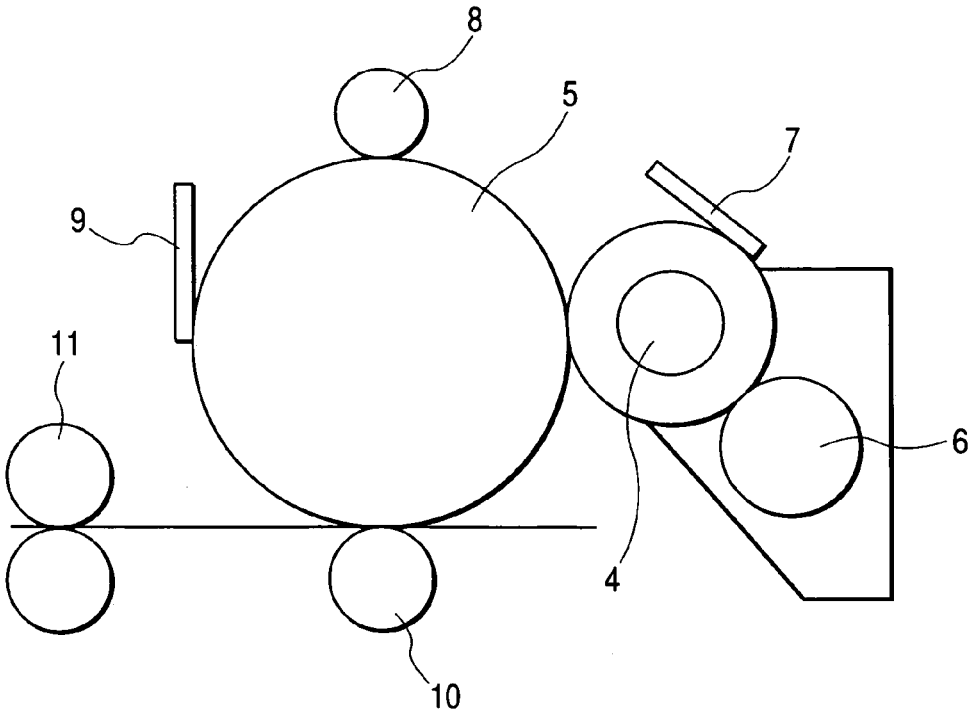
FIG. 2 is a diagrammatic view showing the constitution of a laser printer making use of the developing roller of the present invention.

An example of the electrophotographic image forming apparatus according to the present invention is shown in FIG. 2. More specifically, it consists basically of a toner coating roller 6 for feeding a toner, a charging roller 8 which electrostatically charges a photosensitive drum, and a developing roller 4 which forms a toner image corresponding to an electrostatic latent image held on the photosensitive drum 5. The toner is fed to the surface of the developing roller 4 by means of the toner coating roller 6, and this toner is adjusted to a more uniform thin layer by means of a developing blade 7 which is a toner layer control member. In this state, the developing roller 4 is rotated in contact with the photosensitive drum 5, whereby the toner formed in a thin layer moves from the developing roller 4 and adheres to the latent image held on the photosensitive drum 5, so that the latent image is rendered visible. In FIG. 2, reference numeral 10 denotes a transfer section, where the toner image is transferred to a recording medium such as paper; and 9, a cleaning blade, by means of which the toner remaining on the surface of the photosensitive drum 5 after transfer is removed. Also, in FIG. 2, reference numeral 11 denotes a fixing roller, which fixes the toner image to the recording medium such as paper by the action of heat and pressure.

EXAMPLES

The present invention is described below in greater detail by giving Examples and Comparative Examples. The following Examples by no means limit the present invention.

Example 1

A mandrel of 8 mm in outer diameter was concentrically set in a cylindrical mold of 16 mm in inner diameter, and, as a material for a conductive elastic layer, liquid conductive silicone rubber (a product available from Dow Corning Toray Silicone Co., Ltd.; ASKER-C hardness: 45°; volume resistivity: $10^5$ Ω·cm) was casted into it. Thereafter, this was put into a 130° C. oven, and was heated for 20 minutes to carry out molding. After demolding, the molded product was subjected to secondary vulcanization for 4 hours in a 200° C. oven to produce a roller having a conductive elastic layer of 4 mm in thickness. Here, the universal hardness A of the conductive elastic layer as measured under the above conditions was 0.11 ($N/mm^2$) In addition, the universal hardness was measured with Ultramicrohardness Meter H-100V, manufactured by H. Fischer GmbH, using as an indenter a quadrangular pyramid type diamond indenter having an angle of 136° C. between the opposite faces.

Next, a urethane coating material (trade name: NIPPOLAN N5037; available from Nippon Polyurethane Industry Co., Ltd.) was diluted with methyl ethyl ketone so as to be in a solid-matter concentration of 10%, followed by adding carbon black (trade name: HS-500; available from Asahi Carbon Co., Ltd.) as a conductive material in an amount of 15 parts by weight based on 100 parts by weight of the solid matter, PMMA particles of 15 mm in number-average particle diameter (trade name: MX-1500H; available from Soken Chemical & Engineering Co., Ltd.) as the organic-compound particles (M) in an amount of 20 parts by weight based on 100 parts by weight of the solid matter, and imidazole compound particles of 3 mm in number-average particle diameter (available from Shikoku Chemicals Corp.) of an imidazole compound represented by the following formula (a) as the organic-compound particles (N) in an amount of 3 parts by weight based on 100 parts by weight of the solid matter. Thereafter, these were stirred and dispersed by means of a ball mill, and thereafter a curing agent (trade name: COLONATE L; available from Nippon Polyurethane Industry Co., Ltd.) was added in an amount of 10 parts by weight based on 100 parts by weight of the urethane coating material (not having been diluted), followed by stirring to prepare a coating preparation. The roller molded previously was coated with this coating preparation by dipping, and dried for 15 minutes in a 80° C. oven, followed by curing for 4 hours in a 140° C. oven to obtain a developing roller. Here, the universal hardness B of the developing roller as measured under the above-described conditions was 0.132 (B/A =1.2). Also, the number-average particle diameter of particles in the surface layer of the developing roller as measured with an electron microscope was 15.2 mm in respect of the PMMA particles, and 2.9 mm in respect of the imidazole compound particles.

(a)

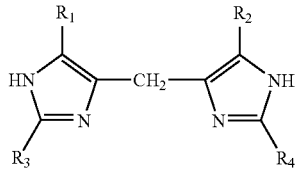

Example 2

A developing roller was obtained in the same manner as in Example 1 except that a curing agent (trade name: C2521; available from Nippon Polyurethane Industry Co., Ltd.) was added in an amount of 5 parts by weight based on 100 parts by weight of the urethane coating material (having not been diluted). Here, the universal hardness B of the developing roller as measured under the above-described conditions was 0.100 (B/A =0.91). Also, the number-average particle diameter of particles of the surface layer of the developing roller as measured with an electron microscope was 15.2 mm in respect of the PMMA particles, and 2.9 mm in respect of the imidazole compound particles.

A developing roller was obtained in the same manner as in Example 1 except that as the curing agent a curing agent (trade name: COLONATE L; available from Nippon Polyurethane Industry Co., Ltd.) was added in an amount of 25 parts by weight based on 100 parts by weight of the urethane coating material (having not been diluted). Here, the universal hardness B of the developing roller as measured under the above-described conditions was 0.198 (B/A =1.8). Also, the number-average particle diameter of particles of the surface layer of the developing roller as measured with an electron microscope was 15.2 mm in respect of the PMMA particles, and 2.9 mm in respect of the imidazole compound particles.

Example 4

A developing roller was obtained in the same manner as in Example 1 except that, as the organic-compound particles (M), urethane particles of 10 μm in number-average particle diameter (trade name: CF600T; available from Negami Chemical Industrial Co., Ltd.) were added in an amount of 20 parts by weight based on 100 parts by weight of the solid matter, and, as the organic-compound particles (N), imidazole compound particles of 1.0 μm in number-average particle diameter (available from Shikoku Chemicals Corp.) of an imidazole compound represented by the following formula (b) were added in an amount of 10 parts by weight based on 100 parts by weight of the solid matter. Here, the universal hardness B of the developing roller as measured under the above conditions was 0.131 (B/A=1.19). Also, the number-average particle diameter of particles in the surface layer of the developing roller as measured with an electron microscope was 9.7 μm in respect of the urethane particles, and 1.2 μm in respect of the imidazole compound particles.

(b)

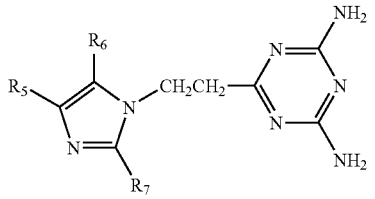

Example 5

A developing roller was obtained in the same manner as in Example 1 except that, as the organic-compound particles (N), imidazole compound particles of 10 mm in number-average particle diameter (available from Shikoku Chemicals Corp.) of the imidazole compound represented by the formula (a) were added in an amount of 3 parts by weight. Here, the universal hardness B of the developing roller as measured under the above-described conditions was 0.132 (B/A =1.2). Also, the number-average particle diameter of particles in the surface layer of the developing roller as measured with an electron microscope was 15.2 mm in respect of the PMMA particles, and 9.8 mm in respect of the imidazole compound particles.

Example 6

A developing roller was obtained in the same manner as in Example 1 except that, as the organic-compound particles (N), imidazole compound particles of 0.5 mm in number-average particle diameter (available from Shikoku Chemicals Corp.) of the imidazole compound represented by the formula (a) were added in an amount of 3 parts by weight. Here, the universal hardness B of the developing roller as measured under the above-described conditions was 0.130 (B/A =1.18). Also, the number-average particle diameter of particles of the surface layer of the developing roller as measured with an electron microscope was 15.2 mm in respect of the PMMA particles, and 0.54 mm in respect of the imidazole compound particles.

Example 7

A developing roller was obtained in the same manner as in Example 1 except that, as the organic-compound particles (N), imidazole compound particles of 13 mm in number-average particle diameter (available from Shikoku Chemicals Corp.) of the imidazole compound represented by the formula (a) were added in an amount of 3 parts by weight. Here, the universal hardness B of the developing roller as measured under the above-described conditions was 0.14 (B/A =1.27). Also, the number-average particle diameter of particles in the surface layer of the developing roller as measured with an electron microscope was 15.2 mm in respect of the PMMA particles, and 12.8 mm in respect of the imidazole compound particles.

Comparative Example 1

A developing roller was obtained in the same manner as in Example 1 except that the imidazole compound particles (available from Shikoku Chemicals Corp.) of the imidazole compound represented by the formula (a) were not added. Here, the universal hardness B of the developing roller as measured under-described the above conditions was 0.128 (B/A =1.16). Also, the number-average particle diameter of particles in the surface layer of the developing roller as measured with an electron microscope was 15.2 mm in respect of the PMMA particles.

Comparative Example 2

A developing roller was obtained in the same manner as in Example 1 except that as the curing agent a curing agent (trade name: C2521; available from Nippon Polyurethane Industry Co., Ltd.) was added in an amount of 8 parts by weight based on 100 parts by weight of the urethane coating material (having not been diluted) and a curing agent (trade name: COLONATE L; available from Nippon Polyurethane Industry Co., Ltd.) was further added in an amount of 5 parts by weight based on 100 parts by weight of the urethane coating material (having not been diluted). Here, the universal hardness B of the developing roller as measured under the above-described conditions was 0.089 (B/A =0.81). Also, the number-average particle diameter of particles in the surface layer of the developing roller as measured with an electron microscope was 15.2 mm in respect of the PMMA particles, and 2.9 m in respect of the imidazole compound particles.

Comparative Example 3

A developing roller was obtained in the same manner as in Example 1 except that as the urethane coating material a urethane coating material (trade name: NIPPOLAN N5196; available from Nippon Polyurethane Industry Co., Ltd.) was used after it was diluted with methyl ethyl ketone so as to be in a solid-matter concentration of 10%. Here, the universal hardness B of the developing roller as measured under the above conditions was 0.213 (B/A=1.94). Also, the number-average particle diameter of particles in the surface layer of the developing roller as measured with an electron microscope was 15.2 μm in respect of the PMMA particles, and 2.9 μm in respect of the imidazole compound particles.

Comparative Example 4

A developing roller was obtained in the same manner as in Comparative Example 3 except that the imidazole compound particles (available from Shikoku Chemicals Corp.) of the imidazole compound represented by the formula (a) were not added. Here, the universal hardness B of the developing roller as measured under the above conditions was 0.208 (B/A=1.89). Also, the number-average particle diameter of particles in the surface layer of the developing roller as measured with an electron microscope was 15.2 μm in respect of the PMMA particles.

Comparative Example 5

A developing roller was obtained in the same manner as in Example 1 except that, as the organic-compound particles (M) and (N), urethane particles of 6 μm in number-average particle diameter (trade name: C800T; available from Negami Chemical Industrial Co., Ltd.) and imidazole compound particles of 1.0 μm in number-average particle diameter (available from Shikoku Chemicals Corp.) of the imidazole compound represented by the formula (a) were added in an amount of 20 parts by weight and 3 parts by weight, respectively, based on 100 parts by weight of the solid matter. Here, the universal hardness B of the developing roller as measured under the above conditions was 0.132 (B/A=1.2). Also, the number-average particle diameter of particles in the surface layer of the developing roller as measured with an electron microscope was 6.2 μm in respect of the urethane particles, and 9.8 μm in respect of the imidazole compound particles.

Image Evaluation

Evaluation on gear pitch horizontal lines:

To make evaluation on the gear pitch horizontal lines, images were reproduced in a normal temperature and normal humidity environment (23° C./55% RH), applying each of the developing rollers produced in the Examples and Comparative Examples to a process cartridge holding a magenta toner therein, and using a color laser beam printer (trade name: COLOR LASER JET 4600; manufactured by Hewlett-Packard Company). Here, solid images at the initial stage were reproduced to make evaluation according to the following judgement criteria.

A: No gear pitch horizontal lines are observed at all.

B: Gear pitch horizontal lines are observed.

C: Gear pitch horizontal lines are clearly observed.

Evaluation on coarse images and density non-uniformity:

To make evaluation on coarse images and density non-uniformity caused by the developing roller, images were reproduced on 10,000 sheets in a normal temperature and normal humidity environment (23° C./55% RH), using the color laser beam printer. Here, solid images and halftone images were reproduced to observe whether or not density non-uniformity or coarse images appeared.

The evaluation results on each roller are shown together in Table 1.

TABLE 1

Results of Image Evaluation

| | Surface layer resin | B/A | Number-average particle diameter of organic = compound particles in surface layer (μm) | Number-average particle diameter of nitrogen-containing hetero-cyclic-compound particles in surface layer (μm) | Gear pitch hori-zontal lines | Coarse images and density non-uniformity |
|---|---|---|---|---|---|---|
| | | | Example: | | | |
| 1 | Urethane | 1.20 | 15.2 | 2.9 | A | None |
| 2 | Urethane | 0.91 | 15.2 | 2.9 | A | None |
| 3 | Urethane | 1.80 | 15.2 | 2.9 | A | None |
| 4 | Urethane | 1.19 | 9.7 | 1.2 | A | None |
| 5 | Urethane | 1.20 | 15.2 | 9.8 | A | None |
| 6 | Urethane | 1.18 | 15.2 | 0.54 | A | Coarse images |
| 7 | Urethane | 1.27 | 15.2 | 12.8 | A | Density non-uniformity |
| | | | Comparative Example: | | | |
| 1 | Urethane | 1.16 | 15.2 | — | B | Coarse images |
| 2 | Urethane | 0.81 | 15.2 | 2.9 | B | None |
| 3 | Urethane | 1.94 | 15.2 | 2.9 | B | None |
| 4 | Urethane | 1.89 | 15.2 | — | C | Coarse images |
| 5 | Urethane | 1.20 | 6.2 | 9.8 | B | None |

As clearly shown in Table 1, it is evident that the developing roller which has at least the elastic layer and the surface layer superposed thereon, and in which the resin material used in the surface layer contains nitrogen atoms, and at least two types of particles, the organic-compound particles (M) and the organic-compound particles (N), are added to the surface layer, of which the particles (N) are the nitrogen-containing heterocyclic-compound particles and the particles (N) have, in the surface layer, a number-average particle diameter smaller than the number-average particle diameter of the particles (M) in the surface layer, which developing roller is so constituted as to satisfy the relationship of the following expression (1):

$$0.9 \leqq B/A \leqq 1.8 \quad (1)$$

(where, in measuring the universal hardness of the elastic layer surface and that of the developing roller surface, the universal hardness of the elastic layer and the universal hardness of the developing roller at an indentation depth of 40 μm in the vertical direction from the surface under measuring conditions of a constant loading speed (50/20 $mN/mm^2$/sec.) are represented by A ($N/mm^2$) and B ($N/mm^2$), respectively); can solve the gear pitch horizontal lines. In Examples 6 and 7, coarse images and density non-uniformity appeared slightly, but very good results were shown on the gear pitch horizontal lines. In Comparative Examples 1 to 4, the rollers do not satisfy the constitution according to the present invention, and hence, resulted in the occurrence of the gear pitch horizontal lines and could not give high-grade images. Also, in Comparative Examples 1 and 4, coarse images appeared slightly on halftone images.

This application claims priority from Japanese Patent Application No. 2003-352494 filed on Oct. 10, 2003, which is hereby incorporated by reference herein.

What is claimed is:

1. A developing roller comprising an elastic layer and a surface layer, wherein;

said surface layer has at least a nitrogen-atom-containing resin, organic-compound particles (M) and organic-compound particles (N), said organic-compound particles (N) are nitrogen-containing heterocyclic-compound particles, said the organic-compound particles (M) and the organic-compound particles (N) have a volume resistivity of $1.0\times10^9$ Ω·cm or more, a number-average particle diameter of said organic-compound particles (N) in said surface layer is smaller than a number-average particle diameter of said organic-compound particles (M) in said surface layer, and a universal hardness A ($N/mm^2$) of the surface of said elastic layer and a universal hardness B ($N/mm^2$) of the surface of said developing roller satisfy the relationship of the following expression:

$$0.9 \leqq B/A \leqq 1.8,$$

where the universal hardness A ($N/mm^2$) and the universal hardness B ($N/mm^2$) are measured at an indentation depth of 40 μm in the vertical direction from the surface of the elastic layer and the surface of the developing roller, respectively.

2. The developing roller according to claim 1, wherein the number-average particle diameter of said organic-compound particles (N) in said surface layer is in a range of 1.0 μm to 10 μm.

3. The developing roller according to claim 1, wherein the number-average particle diameter of said organic-compound particles (N) in said surface layer is in a range 1.2 μm to 9.8 μm.

4. The developing roller according to claim 1, wherein the nitrogen-containing heterocyclic-compound of said organic-compound particles (N) is an imidazole compound.

5. The developing roller according to claim 4, wherein said imidazole compound is a compound represented by one of the following formulae (a) and (b):

(a)

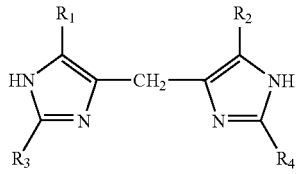

(b)

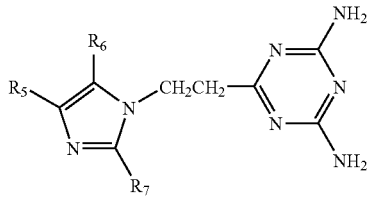

wherein $R_1$ and $R_2$ are each independently a hydrogen atom, an alkyl group, an aralkyl group or an aryl group, and $R_3$ and $R_4$ are each independently a straight-chain alkyl group having 3 to 30 carbon atoms, and wherein $R_5$ and $R_6$ are each independently a hydrogen atom, an alkyl group, an aralkyl group or an aryl group, and $R_7$ is a straight-chain alkyl group having 3 to 30 carbon atoms.

6. The developing roller according to claim 1, wherein said nitrogen-atom-containing resin is a resin selected from the group consisting of a polyamide resin, a urethane resin, a urea resin, an imide resin and a melamine resin.

7. The developing roller according to claim 1, wherein said nitrogen-atom-containing resin is a urethane resin.

8. The developing roller according to claim 1, wherein said organic-compound particles (M) are polymethyl methacrylate (PMMA) particles.

9. The developing roller according to claim 1, wherein the universal hardness of the surface of the developing roller B ($N/mm^2$) is 0.100 $N/mm^2$ to 0.198 $N/mm^2$.

10. An electrophotographic process cartridge detachably mountable to a main body of an electrophotographic image forming apparatus, wherein said cartridge has at least a latent image bearing member and the developing roller according to any one of claims 1 to 8.

11. The electrophotographic process cartridge according to claim 10, wherein said developing roller is provided in contact with said latent image bearing member.

12. An electrophotographic image forming apparatus comprising at least a latent image bearing member on which a latent image to be visualized with a toner can be formed, and a developing roller which holds the toner on its surface to form a toner thin layer and feeds the toner from the toner thin layer to the latent image bearing member, wherein said developing roller is the developing roller according to any one of claims 1 to 8.

13. The electrophotographic image forming apparatus according to claim 12, wherein said developing roller is provided in contact with said latent image bearing member.

* * * * *

UNITED STATES PATENT AND TRADEMARK OFFICE

CERTIFICATE OF CORRECTION

PATENT NO. : 7,127,200 B2
APPLICATION NO. : 10/952741
DATED : October 24, 2006
INVENTOR(S) : Minoru Nakamura et al.

It is certified that error appears in the above-identified patent and that said Letters Patent is hereby corrected as shown below:

ON THE TITLE PAGE:
At Item (57), Abstract, Line 12, "satisfies" should read --satisfy--.

COLUMN 4:
Line 21, "preferably" should read --preferably be--.
Line 22, "Asker-C" should read --ASKER-C--.

COLUMN 5:
Line 6, "is" should read --are--.
Line 49, "invention has." should read --invention.--.

COLUMN 6:
Line 7, "1.0 mm" should read --1.00 μm--; "30 mm" should read --30 μm--; and "3.0 mm" should read --3.0 μm--.
Line 8, "20 mm." should read --20 μm.--.
Line 11, "1.0 mm" should read --1.0 μm--; and "10 mm," should read --10 μm,--.
Line 12, "2.0 mm" should read --2.0 μm--; and "8.0 mm," should read --8.0 μm,--.
Line 27, "a's" should read --as--.

COLUMN 7:
Line 44, "is," should read --is--.

COLUMN 9:
Line 8, "15 mm" should read --15 μm--.
Line 33, "15.2 mm" should read --15.2 μm--; "2.9 mm" should read --2.9 μm--.
Line 57, "15.2 mm" should read --15.2 μm--.
Line 58, "2.9 mm" should read --2.9 μm--.
Line 59, "particles." should read --particles. ¶ Example 3 ¶--.

COLUMN 10:
Line 4, "15.2 mm" should read --15.2 μm--.
Line 5, "2.9 mm" should read --2.9 μm--.
Line 44, "10 mm" should read --10 μm--.
Line 52, "15.2 mm" should read --15.2 μm--.
Line 53, "9.8 mm" should read --9.8 μm--.
Line 60, "0.5 mm" should read --0.5 μm--.

UNITED STATES PATENT AND TRADEMARK OFFICE

CERTIFICATE OF CORRECTION

PATENT NO. : 7,127,200 B2
APPLICATION NO. : 10/952741
DATED : October 24, 2006
INVENTOR(S) : Minoru Nakamura et al.

It is certified that error appears in the above-identified patent and that said Letters Patent is hereby corrected as shown below:

COLUMN 11:
Line 2, "15.2mm" should read --15.2 μm--.
Line 3, "0.54 mm" should read --0.54 μm--.
Line 11, "13 mm" should read --13 μm--.
Line 19, "15.2 mm" should read --15.2 μm--.
Line 20, "12.8 mm" should read --12.8 μm--.
Line 31, "under-described the above" should read --under the above-described--.
Line 35, "15.2 mm" should read --15.2 μm--.
Line 55, "15.2 mm" should read --15.2 μm--.
Line 56, "2.9 m" should read --2.9 μm--.

COLUMN 14:
Line 40, "wherein;" should read --wherein:--.
Line 46, "the" (first occurrence) should be deleted.

COLUMN 15:
Line 3, "range" should read --range of--.

Signed and Sealed this

Seventh Day of August, 2007

JON W. DUDAS
*Director of the United States Patent and Trademark Office*